US005439354A

United States Patent [19]

Hansen et al.

[11] Patent Number: 5,439,354

[45] Date of Patent: Aug. 8, 1995

[54] HOLLOW AIRFOIL IMPACT RESISTANCE IMPROVEMENT

[75] Inventors: Kurt L. Hansen, Cincinnati; Jay L. Cornell, Hamilton; Jan C. Schilling, Middletown, all of Ohio

[73] Assignee: General Electric Company, Cincinnati, Ohio

[21] Appl. No.: 76,668

[22] Filed: Jun. 15, 1993

[51] Int. Cl.[6] ..... F01D 5/18

[52] U.S. Cl. ..... 416/233; 416/96 A

[58] Field of Search ..... 416/232, 233, 96 A

[56] References Cited

U.S. PATENT DOCUMENTS

| | | | |
|---|---|---|---|
| 2,615,520 | 10/1952 | Liedholm | 416/233 |
| 2,642,263 | 6/1953 | Thorp, II | 253/77 |
| 2,698,666 | 1/1955 | Camping et al. | 416/233 |
| 2,807,437 | 9/1957 | Roush | 253/77 |
| 3,560,107 | 2/1971 | Helms | 416/90 |
| 3,628,226 | 12/1971 | Nelson | 416/233 |
| 4,162,136 | 7/1979 | Parkes | 416/97 R |
| 4,168,938 | 9/1979 | Dodd | 416/97 R |
| 4,286,924 | 12/1981 | Gale | 416/97 R |
| 4,461,612 | 7/1984 | Dodd | 416/96 A |
| 4,507,051 | 3/1985 | Lesgourgues et al. | 416/97 R |
| 4,643,647 | 2/1987 | Perry | 416/230 |
| 4,685,864 | 8/1987 | Angus | 416/229 |
| 4,815,939 | 3/1989 | Doble | 416/233 |
| 4,882,823 | 11/1989 | Weisert et al. | 29/6.1 |
| 5,099,573 | 3/1992 | Krauss et al. | 28/889.2 |
| 5,269,058 | 12/1993 | Wiggs et al. | 416/233 |

FOREIGN PATENT DOCUMENTS

| | | | |
|---|---|---|---|
| 0407340 | 9/1944 | Italy | 416/232 |
| 0731573 | 6/1955 | United Kingdom | 416/233 |
| 0833770 | 4/1960 | United Kingdom | 416/96 A |
| 1078116 | 8/1967 | United Kingdom | 416/96 A |
| 1270992 | 7/1968 | United Kingdom . | |
| 2009330 | 6/1979 | United Kingdom . | |

*Primary Examiner*—Edward K. Look
*Assistant Examiner*—Mark Sgantzos
*Attorney, Agent, or Firm*—Andrew C. Hess; David L. Narciso

[57] ABSTRACT

Hollow airfoils, such as fan blades, nozzles and struts used in axial flow gas turbine engines, that have improved resistance to impact from foreign objects are disclosed. Relocation of airfoil material is used to preferentially strengthen the airfoil to respond to the stress from the impact of a foreign object. Internal spacers are redistributed toward the leading edge and the material from the skin of the concave side and the convex side is shifted from one side to the other and toward the leading edge of the airfoil where impact stress is greatest.

22 Claims, 5 Drawing Sheets

HOLLOW AIRFOIL IMPACT RESISTANCE IMPROVEMENT

The present invention relates, in general, to hollow core airfoil structures and more particularly to hollow core airfoils including structures, such as fan blades, nozzles and struts for axial flow gas turbine engines, that are preferentially strengthened to resist the impact from a foreign object.

BACKGROUND OF THE INVENTION

Modern high bypass turbofan engines incorporate various types of airfoils such as fan blades, nozzles and struts. In particular, wide chord fan blades improve aerodynamic efficiency and improve tolerance to impact from foreign objects. To minimize system weight, airfoils and their root attachments (dovetails) are often made hollow by joining premachined sections together into a final assembly. Common internal core constructions rely on the use of radial ribs or trusses evenly spaced within the cavity. These features serve as the support structures for the outer skins, and act to carry centrifugal loading, support the skins against gas pressure and foreign object impact loading, such as from birds, and provide stiffness.

Strength requirements in some components, particularly airfoils in the early stages of gas turbine engines, vary across the part. For instance, impact strength is a primary concern on the forward edge of the airfoil. Equally spaced rib or truss members provide uniform strength across the blade even though strength requirements are not uniform. Certain airfoil areas would benefit by more support. Adding more ribs or trusses or increasing skin thickness accomplishes this effect, but at a substantial weight penalty.

In a gas turbine engine, added weight in blades necessitates added weight in other hardware, including the disk, stationary structures, and the containment system. This in turn, increases fuel burn and customer cost. More ribs or trusses also add to machining time, tooling costs, and inspection time, which further drives up production costs.

Accordingly, the present invention provides a new arrangement of internal structural members that improves the impact strength of hollow airfoil components subjected to impact from foreign objects, such as birds, while maintaining existing aerodynamic function of the airfoil, minimizing airfoil weight and minimizing machining and inspection time.

SUMMARY OF THE INVENTION

In carrying out this invention, in one form thereof, a preferentially strengthened hollow airfoil that has a flow axis extending from a forward location to an aft location is provided for a gas turbine engine. The airfoil includes a root section located at the base of the airfoil; a tip section located distally from the root section, a leading edge connecting the root section and the tip section and facing forward along the flow axis; a trailing edge connecting the root section and the tip section and facing aft along the flow axis; an outer skin that extends between and connects the root section, the tip section, the leading edge and the trailing edge and forms an outer surface of the airfoil; and one or more spacers located between the leading edge and the trailing edge and enclosed by the skin and forming a plurality of non-uniformly sized cavities.

Based on nonlinear transient dynamic analysis of an airfoil application, preferential strengthening is accomplished by rearranging one or more spacers between the leading edge and the trailing edge of the airfoil and by varying skin thickness on one side of the airfoil relative to the other side and along the length of each side to form a plurality of non-uniformly sized cavities. The location of each spacer is chosen to minimize the strains due to initial impact shock, and later to the transient response that occurs from a foreign object impact. The airfoil thickness or exterior shape is not changed. Preferential strengthening is further enhanced by preferential thickness control of the skin material without increasing weight. The skin material is rearranged in response to the predicted stress caused by the impact from a foreign object. For example, in one application for a fan blade of a gas turbine engine, the convex side skin thickness of the fan airfoil would be increased while the concave side skin thickness of the fan airfoil would be decreased. Additional skin thickness on the convex side is needed to prevent compressive buckling while a thinner concave side could survive the increased tension generated by a foreign object impact. Also, in this example, the skin thickness of both sides near the leading edge of the airfoil would be preferentially increased further to withstand the direct impact of a foreign object. Even though the convex side is generally thicker than the concave side, the skin thickness of the leading edge of both sides is preferentially increased at the expense of the skin thickness at the trailing edge of the blade thereby improving impact resistance without increasing weight.

In one embodiment of this invention, the airfoil is in the form of a fan blade and has ten cavities of varying width as measured along the chord of the airfoil. Starting at the leading edge of the airfoil, the first cavity is the narrowest and the next four cavities are slightly wider in succession. The sixth cavity through the tenth cavity each have the same width which is the widest cavity dimension and designated as width L. The first cavity width is generally between 0.45 L and 0.55 L inclusive, the second cavity width is generally between 0.55 L and 0.65 inclusive, the third cavity width is generally between 0.65 L and 0.75 L inclusive, the fourth cavity is generally between 0.75 L and 0.85 L inclusive and the fifth cavity is generally between 0.85 L and 0.95 L inclusive. The decreased width of the cavities toward the leading edge of the airfoil is advantageous. The airfoil will be preferentially strengthened along the leading edge and will be able to resist impact from a foreign object, such as a bird ingested by a gas turbine engine. Also, by shifting the spacing between support members, the leading edge strength will be increased without increasing the overall weight of the airfoil.

The support members, which serve as the spacers, separating the concave side and the convex side can be shaped several ways while still performing the function of supporting the outer skin in an airfoil shape. Most commonly, the support members are ribs, lands, stringers or trusses. Each structure will accommodate varied cavity size. There are several manufacturing processes and each is generally indicative of which structure to use. For example, a two piece diffusion bonding process would indicate ribs while a three piece diffusion bonding process would indicate a truss.

In another embodiment of the present invention, either separately or in combination with the first embodiment, the skin thickness, T, of the airfoil is varied to improve the airfoil's strength distribution. The skin thickness is preferentially increased on the convex side and correspondingly decreased on the concave side which improves airfoil resistance to impact without adding weight. Additionally, the skin thickness is preferentially increased along the cavities near the leading edge of the airfoil to further improve airfoil strength in the leading edge area where an impact from a foreign object is most likely to occur. The skin thickness on the convex side is generally B inches thicker than the corresponding skin thickness on the concave side, where B is between 0.005 inches and 0.025 inches. The skin thickness of the cavities nearest to the leading edge of the airfoil is preferentially increased between 40% and 60% for the first cavity closest to the leading edge, between 20% and 40% for the second cavity from the leading edge and between 0% and 20% for the third cavity from the leading edge while typical increases in skin thickness are 50%, 30% and 10% for the first, second and third cavities from the leading edge respectively.

In new airfoil designs, the positioning of internal support members for hollow airfoils and the choice of skin thickness distribution is done while minimizing airfoil weight and without altering aerodynamic or acoustic performance.

When applied to an existing hollow airfoil design, the present invention applies to internal changes and can be understood as a redistribution of existing material to locations to preferentially increase the strength of the airfoil to match the calculated stress from the impact with a foreign object. Additional material is not added to the airfoil, therefore there is no increase in weight.

In either an existing or a new hollow airfoil design, the positioning of internal support members and the choice of skin thickness distribution may also vary radially between the root section and the tip section and axially between the leading edge and the trailing edge. Each airfoil application has different strength requirements. The present invention contemplates redistributing the airfoil material in all dimensions of the airfoil to achieve the optimum resistance to the impact from a foreign object without compromising requirements for strength and life.

BRIEF DESCRIPTION OF THE DRAWINGS

A more complete understanding of the invention may be had by referring to the accompanying drawings in which.

DESCRIPTION OF THE PREFERRED EMBODIMENTS

Figure 1:
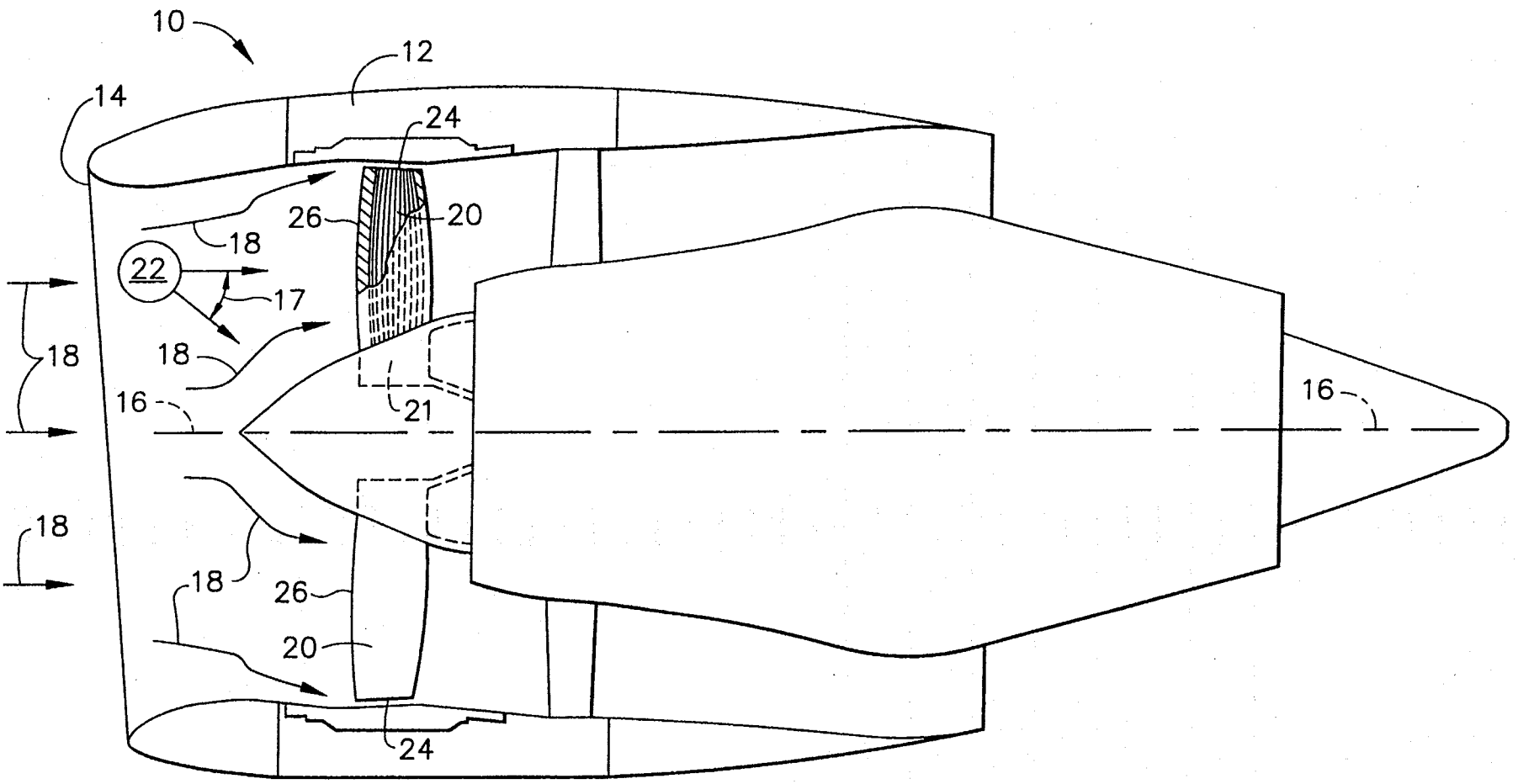
FIG. 1 illustrates a cross sectional view of a gas turbine engine showing a hollow airfoil in the forward section.

Referring now to the Figures wherein like reference numerals have been used throughout to designate like parts. FIG. 1 illustrates a typical cross-sectional view of an axially symmetric gas turbine engine 10 having a nacelle 12 with an inlet 14 located forward along flow axis 16 of the gas turbine engine 10. The inlet 14 controls airflow 18 toward a plurality of hollow fan blades 20 that are encircled by nacelle 12 and are connected to gas turbine engine 10 at fan rotor 21. Fan blades 20 rotate about flow axis 16 and are vulnerable to being struck by any foreign object 22 entering inlet 14. Generally, foreign object 22 travels parallel to flow axis 16, however foreign object 22 may enter inlet 14 at an angle 17 that is not parallel to flow axis 16. After entering inlet 14, foreign object 22 will strike fan blade 20 along leading edge 26 at a relative velocity equivalent to the vector sum of fan blade velocity and foreign object 22 velocity which can be as high as 500 mph for commercial applications and mach 3 or higher for military applications.

Foreign object 22 in the normal operation of a gas turbine engine 10 ranges from small particles, for example sand, to large objects, for example, birds. The smaller foreign objects 22 generally do not cause major damage to the gas turbine engine or reduce its performance because they do not have much energy. However, a large bird has a much greater energy content and can cause significant damage. At a minimum, the ingestion of a large foreign object may damage fan blades 20 which may result in rotational imbalance.

Figure 2:
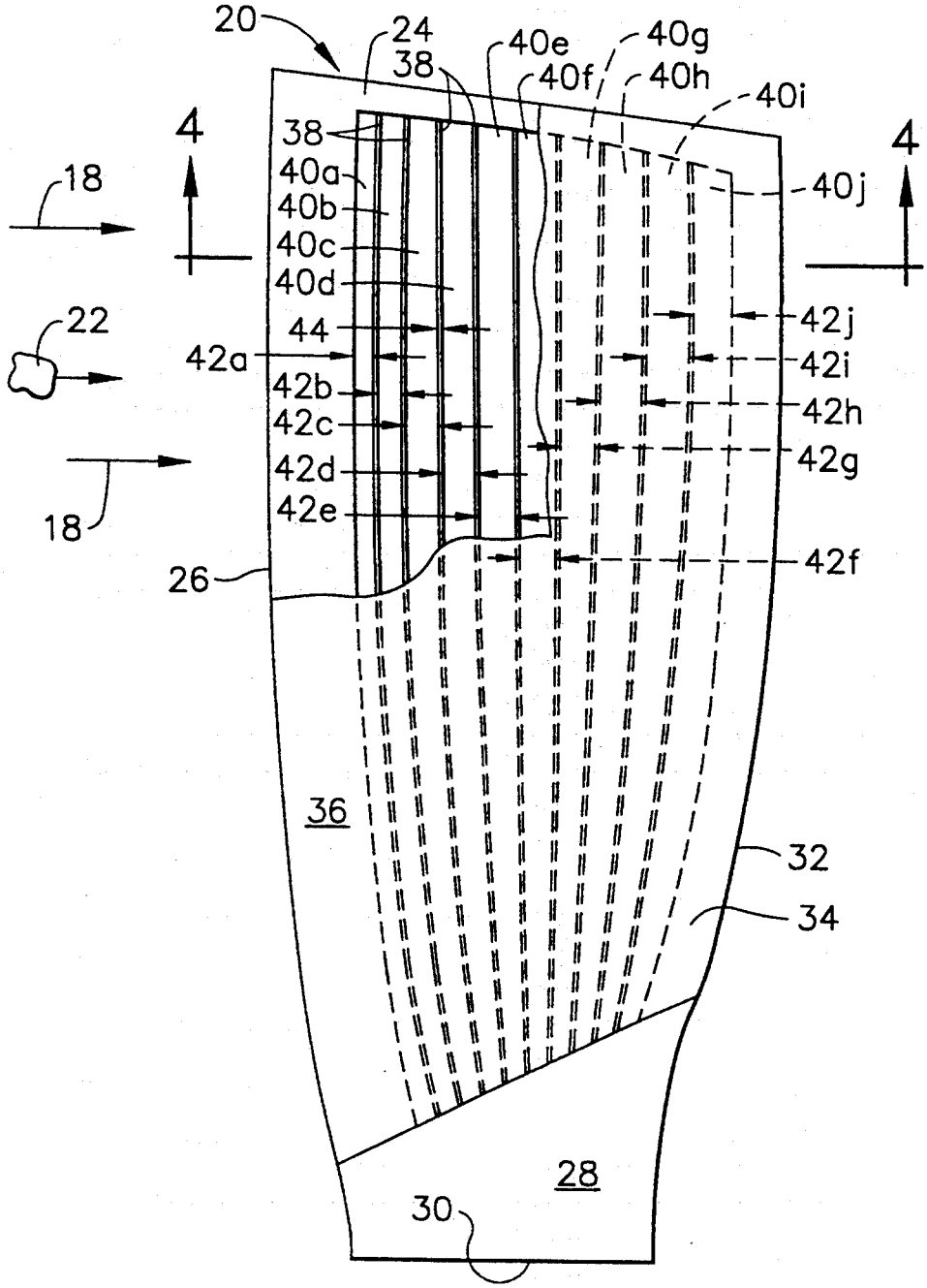
FIG. 2 illustrates a cutaway view of a hollow airfoil configured as a wide chord fan blade.

FIG. 2 illustrates a cutaway view of a preferred embodiment of the present invention configured as a hollow fan blade 20 with ribs 38 spaced a non-uniform distance apart. Fan blade 20 has a root section 28, located adjacent to base 30 of fan blade 20. Blade tip 24 is radially distal from root section 28 and is connected to root section 28 by leading edge 26 and trailing edge 32. Outer skin 34 connects root section 28, blade tip 24, leading edge 26 and trailing edge 32 and forms outer surface 36 of hollow fan blade 20. Leading edge 26 generally faces forward and trailing edge 32 generally faces aft. Root section 28 supports and connects hollow fan blade 20 to gas turbine engine 10 (FIG. 1) at fan rotor 21.

Outer skin 34 encloses a plurality of ribs 38 that serve as spacers to separate a plurality of cavities 40*a* through 40*j*. Cavities 40*a* through 40*j* have non-uniform widths 42*a* through 42*j*. Each of widths 42*a* through 42*j* of corresponding cavities 40*a* through 40*j* is, according to the present invention, narrower adjacent leading edge 26 than adjacent trailing edge 32. Rib thickness 44 is generally uniform for each rib 38; however, the present invention contemplates that thickness 44 may vary as needed to achieve the desired strength distribution of fan blade 20.

Figure 3:
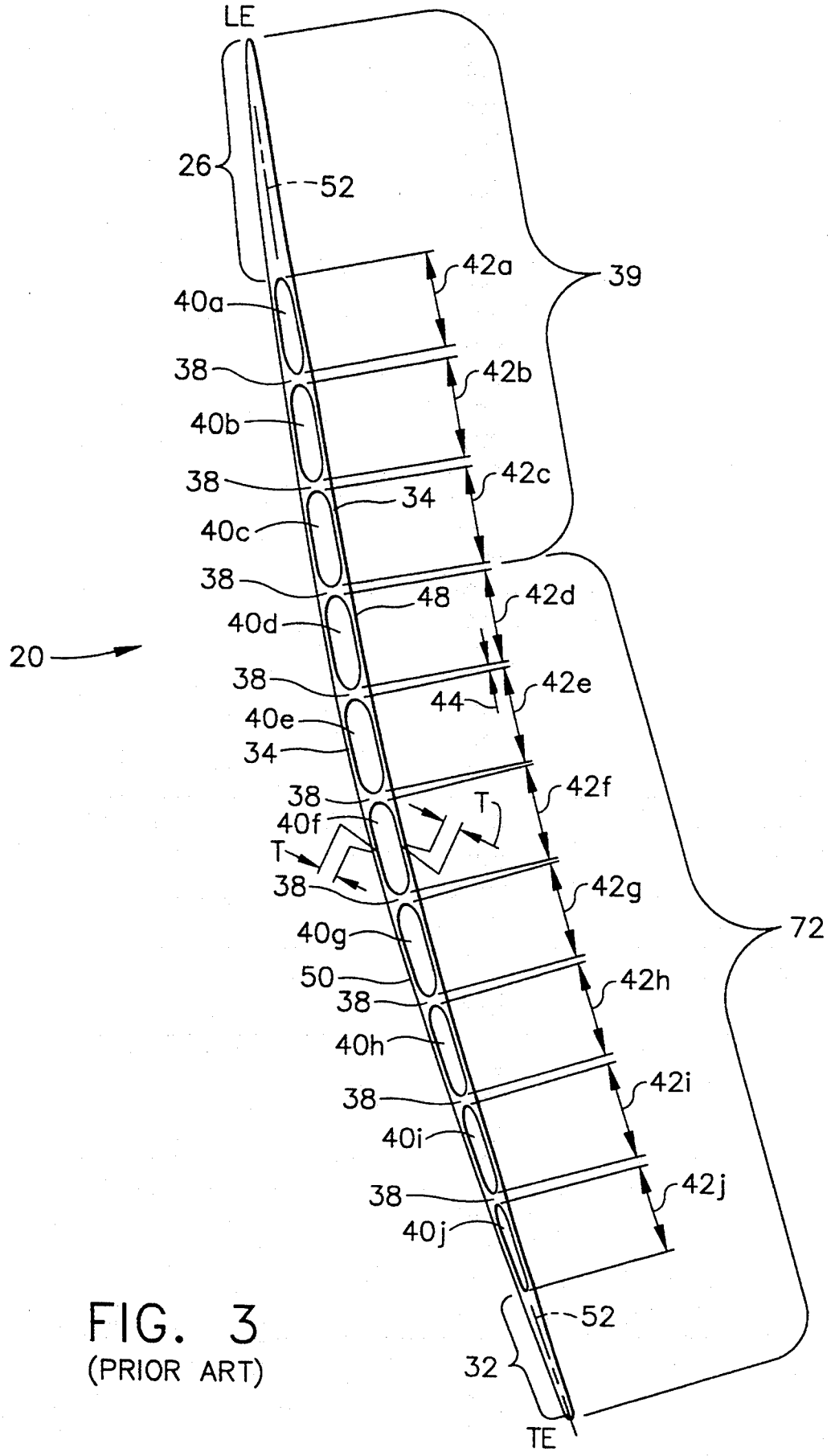
FIG. 3 (PRIOR ART)
FIG. 3 illustrates a radial cross section of a conventional hollow airfoil.

FIG. 3 illustrates a cross section of a hollow airfoil 20 of conventional design. Skin 34 has uniform thickness T on concave side 48 and on convex side 50. Cavities 40*a* through 40*j* have equal widths 42*a* through 42*j* and are uniformly spaced between leading edge 26 and trailing edge 32 along chord length 52. Likewise, rib thickness 44 is uniform for each rib 38 that separates cavities 40*a* through 40*j*.

The present invention improves the impact resistance of the conventional airfoil shown in FIG. 3 by rearranging the location, spacing and size of cavities 40*a* through 40*j* to preferentially stiffen the airfoil and by adjusting skin thickness, T, without adding weight or changing its aerodynamic or acoustic performance.

Figure 4:
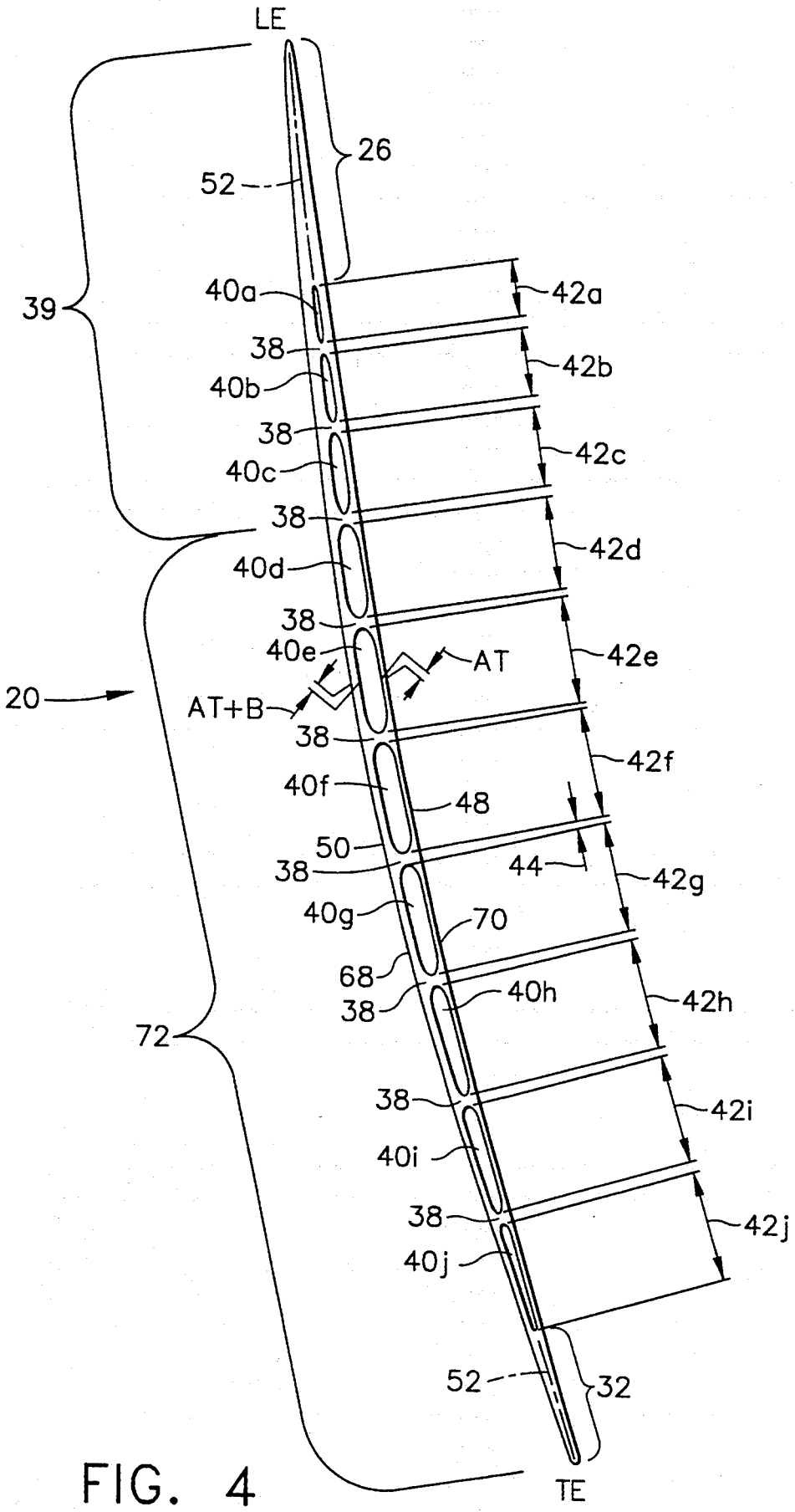
FIG. 4 illustrates a radial cross section of a hollow airfoil according to one embodiment of the present invention showing ribs that have non-uniform cavity width and preferential skin thickening.

The preferred embodiment of the present invention is again illustrated in FIG. 4. Fan blade 20 is illustrated; however any airfoil susceptible to impact, whether stationary or moving, would benefit from the present invention and is contemplated herein.

Fan blade 20 illustrated in FIG. 4, has ten (10) cavities 40*a* through 40*j* of non-uniform width. In another embodiment of the present invention there may be a different number of cavities. Cavity 40*a* has the narrowest width 42*a* and is located adjacent leading edge 26. Succeeding cavities 40*b* through 40*j* have widths 42*b* through 42*j* respectively that are greater than width 42*a*. Widths 42*b* through 42*e* are successively larger than width 42*a*. Widths 42*f* through 42*j* are equal for cavities 40*f* through 40*j* in the present embodiment; however, a non-uniform width is contemplated for these cavities in alternate embodiments of the present invention and would be determined by the specific airfoil application. Ribs 38 separate cavities 40*a* through 40*j* and generally have a uniform width 44; however a non-uniform width is contemplated for ribs 38 in any alternate embodiment of the present invention. Cavity widths 42*a* through 42*j* are generally described by the following equation:

$$0.4L \leqq x < L$$

where, x, represents cavity width and L is the width of the widest cavity.

Preferential strengthening of fan blade 20 is further enhanced by adjusting skin thickness, T, from FIG. 3 to accommodate the tension and compression stresses on concave side 48 and convex side 50 resulting from a foreign object 22 impact on leading portion 39. Care is taken to thicken convex skin 68 while thinning concave skin 70 of FIG. 4 Without increasing weight of fan blade 20. The concave skin thickness is generally represented as being AT inches and the convex side skin thickness is generally represented as being (AT+B) inches. B, as contemplated in the present invention, is between 0.005 inches and 0.025 inches and A is between 1 and 1.6. In an alternate embodiment where the tension and compression stresses may be reversed, concave skin 70 may be thickened while thinning convex skin 68 in similar fashion.

Preferential strengthening of fan blade 20 is further enhanced by further increasing the skin thickness for a selected number of cavities 40*a*, 40*b* and 40*c*, along leading portion 39 of fan blade 20. The additional thickening is incrementally increased for the selected cavities on both the concave and convex sides related to the uniform skin thickness for the cavities in trailing portion 72. Depending on the airfoil application, skin thickness may also vary radially.

Concave skin 70 and convex skin 68 for leading portion 39, cavities 40*a*, 40*b* and 40*c*, both have an increased skin thickness by a factor, A, relative to their uniform skin thickness, T and T+B, respectively. In the present invention A is between 1.0 and 1.6 where A for cavities 40*a*, 40*b*, and 40*c* is between 1.4 and 1.6 inclusive, between 1.2 and 1.4 inclusive and between 1.0 and 1.2 inclusive, respectively. A, for cavities 40*d* through 40*j*, is 1.0. Generally, concave skin thickness is AT and convex skin thickness is AT+B. In alternate embodiments, leading portion 39 of fan blade 20 may encompass a different number of cavities from the three shown in FIG. 3 and the value of A may vary radially and along chord length 52 depending on the application.

At a given radial location along fan blade 20, cavity length and skin thickness, for the preferred embodiment illustrated in FIG. 4, can best be described by referring to Table 1. The size relationship among cavities and skin thicknesses may vary radially depending on airfoil application. A table similar to Table I may be generated for each radial cross section of a given airfoil for any given application.

TABLE 1

| CAVITY | CAVITY WIDTH $.4L \leqq x \leqq L$ (X) | Convex Side Skin Thickness $T + .005 \leqq y \leqq 1.6T + .025$ (Y) | Concave Side Skin Thickness $T \leqq Z \leqq 1.6T$ (Z) |
|---|---|---|---|
| 40a | $.4L \leqq x \leqq .6L$ | $1.4T + .005 \leqq y \leqq 1.6T + .025$ | $1.4T \leqq Z \leqq 1.6T$ |
| 40b | $.5L \leqq x \leqq .7L$ | $1.2T + .005 \leqq y \leqq 1.4T + .025$ | $1.2T \leqq Z \leqq 1.4T$ |
| 40c | $.6L \leqq x \leqq .8L$ | $T + .005 \leqq y \leqq 1.2T + .025$ | $T < Z \leqq 1.2T$ |
| 40d | $.7 \leqq x \leqq .9L$ | $T + .005 \leqq y \leqq T + .025$ | $Z = T$ |
| 40e | $.8L \leqq x \leqq L$ | $T + .005 \leqq y \leqq T + .025$ | $Z = T$ |
| 40f | $x = L$ | $T + .005 \leqq y \leqq T + .025$ | $Z = T$ |
| 40g | $x = L$ | $T + .005 \leqq y \leqq T + .025$ | $Z = T$ |
| 40h | $x = L$ | $T + .005 \leqq y \leqq T + .025$ | $Z = T$ |
| 40i | $x = L$ | $T + .005 \leqq y \leqq T + .025$ | $Z = T$ |
| 40j | $x = L$ | $T + .005 \leqq y \leqq T + .025$ | $Z = T$ |

In Table 1 all dimensions are in inches, X is cavity width, Y is convex skin thickness, Z is concave skin thickness, L is the width of the widest cavity which usually is cavity 40*j* closest to trailing edge 32 and T is the thinnest skin thickness which usually is the concave side of cavity 40*j* closest to trailing edge 32. L, T and the number of cavities are parameters that are application dependent and are selected by the designer to minimize airfoil weight while maintaining all functional requirements.

Figure 5:
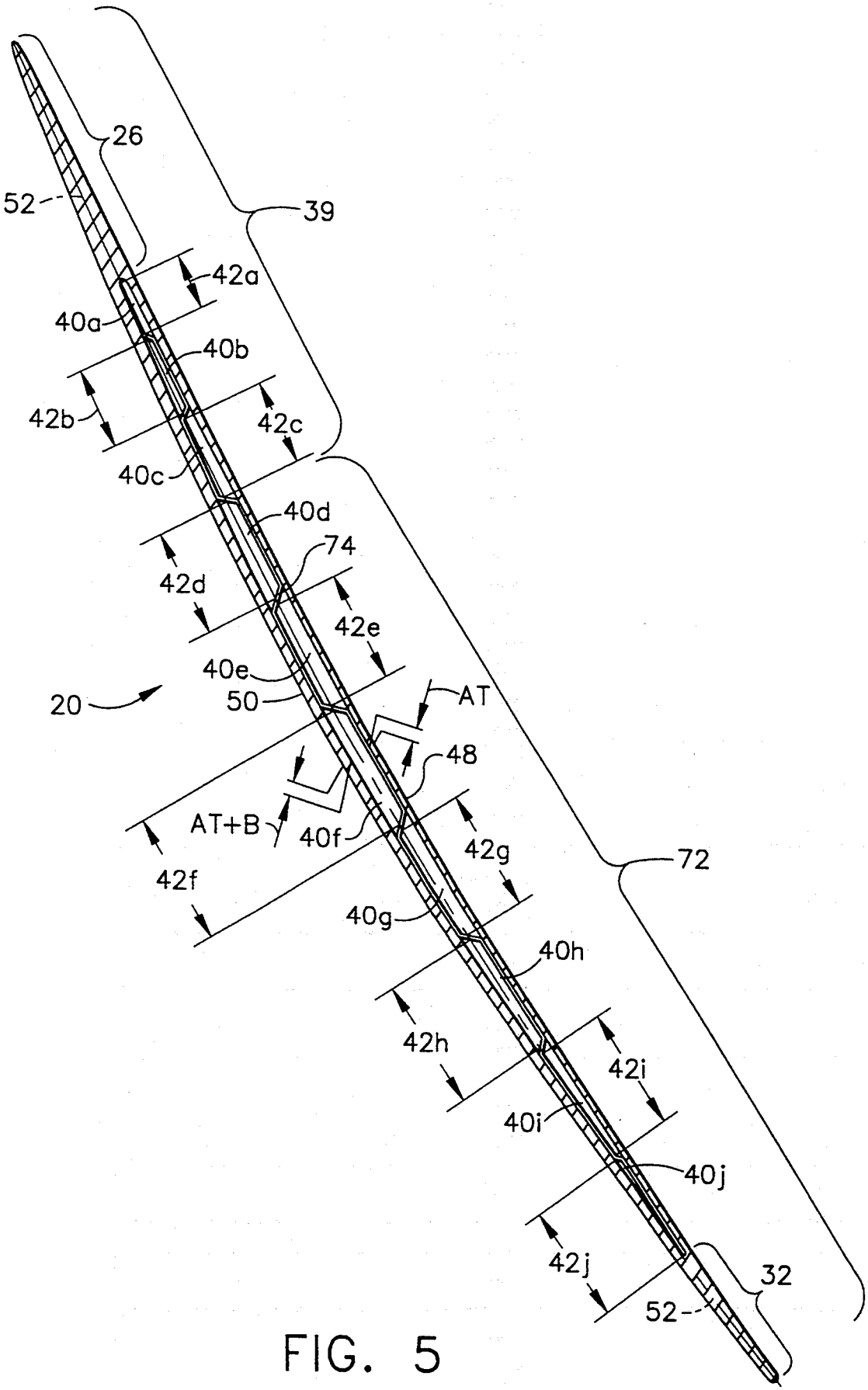
FIG. 5 illustrates a radial cross section of a hollow airfoil according to an alternate embodiment of the present invention showing a truss that has non-uniform cavity width and preferential skin thickening.

In an alternate embodiment of the present invention, as illustrated in FIG. 5, a truss 74 replaces ribs 38, illustrated in FIG. 4. Referring again to FIG. 5, the widths 42*a* through 42*j* of cavities 40*a* through 40*j* between portions of the truss that serve as spacers are measured along chord length 52 that bisects fan blade 20 and extends between leading edge 26 and trailing edge 32. Cavity 40*a* is the shortest and is located adjacent leading edge 26 and cavities 40*b* through 40*j* have cavity width 42*b* through 42*j* that increase in similar fashion to cavities 40*b* through 40*j* illustrated in FIG. 4. In FIG. 5, skin thickness, AT, of concave side 48 is thinner than skin thickness, AT+B, of convex side 50. The skin thickness of leading portion 39 cavities 40*a*, 40*b* and 40*c* are further thickened on concave side 48 and on convex side 50 relative to skin thickness of trailing portion 72 cavities 40d through 40*j*. Concave side skin thickness AT and convex side skin thickness AT+B is likewise fully described in Table 1.

The present invention has been described herein by way of example and is not intended to limit the scope of the invention claimed to the specific examples given. It is to be understood that the cavity length, skin thickness, spacer thickness such as ribs or trusses and the overall distribution of airfoil material can be varied beyond the specific limits given without exceeding the scope and intent of the present invention. Accordingly, the invention as anticipated by the inventors is limited only by the following; wherein,

We claim:

1. A hollow airfoil including a flow axis that extends from a forward location to an aft location, said hollow airfoil comprising:

a) a root section located at the base of said airfoil;

b) a tip section located distally from said root section;

c) a leading edge connecting said root section and said tip section and facing forward along the flow axis;

d) a trailing edge connecting said root section and said tip section and facing aft along the flow axis and a chord length extending between said trailing edge and said leading edge that generally bisects a cross section of the airfoil at a radial position between said root and tip sections;

e) a skin that extends between and connects said root section, said tip section, said leading edge and said trailing edges and forms an outer surface of said airfoil;

f) said skin having a first and second oppositely disposed sides extending substantially along said chord length and bounded by said root section, said tip section, said leading edge and said trailing edge;

g) a plurality of spacers located between said leading edge and said trailing edge, each of said spacers extending between and enclosed by and supporting said skin sides and forming a plurality of non-uniformly sized cavities having widths that increase in length from said leading edge towards said trailing edge as measured along said chord length; and h) said spacers angled at an angles other than 90 degrees with respect to said sides and said chord forming a corrugated truss structure with said sides.

2. A hollow airfoil including a flow axis that extends from a forward location to an aft location, said hollow airfoil comprising:

a) a root section located at the base of said airfoil;

b) a tip section located distally from said root section;

c) a leading edge connecting said root section and said tip section and facing forward along the flow axis;

d) a trailing edge connecting said root section and said tip section and facing aft along the flow axis and a chord length extending between said trailing edge and said leading edge that generally bisects a cross section of the airfoil at a radial position between said root and tip sections;

e) a skin that extends between and connects said root section, said tip section, said leading edge and said trailing edge and forms an outer surface of said airfoil;

f) a plurality of spacers located between said leading edge and said trailing edge and enclosed by and supporting said skin and forming a plurality of non-uniformly sized cavities having widths that increase in length from said leading edge towards said trailing edge as measured along said chord length;

g) a first side extending substantially along said chord length as measured from said leading edge to said trailing edge and bounded by said root section, said tip section, said leading edge and said trailing edge; and h) a second side extending substantially along said chord length and bounded by said root section, said tip section, said leading edge and said trailing edge and separated from said first side by said spacers; wherein, said first side and said second side each have a skin thickness distribution that is not equal to each other.

3. A hollow airfoil according to claim 2 wherein said second side has a second side skin thickness X inches thicker than a first side skin thickness of said first side.

4. A hollow airfoil according to claim 3 wherein said second side skin thickness X is between 0.005 inches and 0.025 inches inclusive thicker than said first side skin thickness.

5. A hollow airfoil according to claim 3 wherein said first side skin thickness distribution and said second side skin thickness distribution have increased thickness along said leading edge relative to said thicknesses along said trailing edge, respectively.

6. A hollow airfoil including a flow axis that extends from a forward location to an aft location, said hollow airfoil comprising:

a) a root section located at the base of said airfoil;

b) a tip section located distally from said root section;

c) a leading edge connecting said root section and said tip section and facing forward along the flow axis;

d) a trailing edge connecting said root section and said tip section and facing aft along the flow axis an a chord length extending between said trailing edge and said leading edge that generally bisects a cross section of the airfoil at a radial position between said root and tip sections;

e) a skin that extends between and connects said root section, said tip section, said leading edge and said trailing edge and forms an outer surface of said airfoil:

f) a plurality of spacers located between said leading edge and said trailing edge and enclosed by and supporting said skin and forming a plurality of non-uniformly sized cavities having widths that increase in length from said leading edge towards said trailing edge as measured along said chord length;

g) said plurality of cavities is a first plurality of cavities having first, second, third, fourth and fifth cavities, each cavity having a first, second, third, fourth and fifth non-uniform width respectively along said chord length; and h) a second plurality of cavities having sixth, seventh, eighth, ninth and tenth cavities each having an equal width Y along said chord length.

7. A hollow airfoil according to claim 6 wherein said first non-uniform width is in a range between and including 0.45Y and 0.55Y, said second non-uniform width is in a range between and including 0.55Y and 0.65Y, said third non-uniform width is in a range between and including 0.65Y and 0.75Y, said fourth non-uniform width is in a range between and including 0.75Y and 0.85Y, and said fifth non-uniform width is in a range between and including 0.85Y and 0.95Y, inclusive.

8. A hollow airfoil including a flow axis that extends from forward location to an aft location, said hollow airfoil comprising:

a) a root section located at the base of said airfoil;

b) a tip section located distally from said root section;

c) a leading edge connecting said root section and said tip section and facing forward along the flow axis;

a trailing edge connecting said root section and said tip section and facing aft along the flow axis and a chord length extending between said trailing edge and said leading edge that generally bisects a cross section of the airfoil at a radial position between said root and tip sections;

e) a skin that extends between an connects said root section, said tip section, said leading edge and said trailing edge and forms an outer surface of said airfoil;

f) a plurality of spacers located between said leading edge and said trailing edge and enclosed by and supporting said skin and forming a plurality of non-uniformly sized cavities having widths that increase in length from said leading edge towards said trailing edge as measured along said chord length;

g) a first side extending substantially along said chord length measured from said leading edge to said trailing edge and bounded by said root section, said tip section, said leading edge and said trailing edge; and h) a second side extending substantially along said chord length and bounded by said root section, said tip section, said leading edge and said trailing edge and separated from said first side by said spacers wherein said first side is thicker than said second side.

9. A hollow airfoil according to claim 8 wherein said first side is thicker than said second side by an amount in the rage of between 0.005 inches and 0.025 inches inclusive.

10. A hollow airfoil according to claim 8 wherein, said first side skin thickness and said second side skin thickness are each greater along said leading edge than along said trailing edge, respectively.

11. A hollow airfoil including a flow axis that extends from a forward location to an aft location, said hollow airfoil comprising:

a) a root section located at the base of said airfoil;

b) a tip section located distally from said root section;

c) a leading edge connecting said root section and said tip section and facing forward along the flow axis;

d) a trailing edge connecting said root section and said tip section and facing aft along the flow axis and a chord length extending between said trailing edge and said leading edge that generally bisects a cross section of the airfoil at a radial position between said root and tip sections;

e) a skin that extends between and connects said root section, said tip section, said leading edge and said trailing edge and forms an outer surface of said airfoil;

f) said skin having a first and second oppositely disposed sides extending substantially along said chord length and bounded by said root section, said tip section, said leading edge and said trailing edge;

g) a plurality of spacers located between said leading edge and said trailing edge, each of said spacers extending between and enclosed by and supporting said skin sides and forming a plurality of non-uniformly sized cavities having widths that increase in length from said leading edge towards said trailing edge as measured along said chord length;

h) said plurality of cavities is a first plurality of cavities having first, second, third, fourth and fifth cavities, each cavity having a first, second, third, fourth and fifth non-uniform width respectively as measured along said chord length; and i) a second plurality of cavities having sixth, seventh, eighth, ninth and tenth cavities each having an equal width Y as measured along said chord length.

12. A hollow airfoil according to claim 11 wherein said first non-uniform width is in a range between and including 0.45Y and 0.55Y, said second non-uniform width is in a range between and including 0.55Y and 0.65Y, said third non-uniform width is in a range between and including 0.65Y and 0.75Y, said fourth non-uniform width is in a range between and including 0.75Y and 0.85Y, and said fifth non-uniform width is in a range between and including 0.85Y and 0.95Y, inclusive.

13. A hollow airfoil according to claim 11 wherein said first side skin thickness for said first cavity is between 1.4 Z and 1.6 Z inclusive, said first side skin thickness for said second cavity is between 1.2 Z and 1.4 Z inclusive, and said first side skin thickness for said third cavity is between Z and 1.2 Z, inclusive; and said second side skin thickness for said first cavity is between 1.4Z+B and 1.6Z+X inclusive, said second side skin thickness for said second cavity is between 1.2Z+X and 1.4Z+X inclusive, and said second side skin thickness for said third cavity is between Z+X and 1.2Z+X inclusive; wherein Z is the thinnest skin thickness of said sides and X is between 0.005 inches and 0.025 inches.

14. A hollow airfoil according to claim 5 wherein said first side skin thickness for said first cavity is between 1.4 Z and 1.6 Z inclusive, said first side skin thickness for said second cavity is between 1.2 Z and 1.4 Z inclusive, and said first side skin thickness for said third cavity is between Z and 1.2 Z, inclusive; and said second side skin thickness for said first cavity is between 1.4Z+X and 1.6Z+X inclusive, said second side skin thickness for said second cavity is between 1.2Z+X and 1.4Z+X inclusive, and said second side skin thickness for said third cavity is between Z+X and 1.2Z+X inclusive; wherein Z is the thinnest skin thickness of said sides and X is between 0.005 inches and 0.025 inches.

15. A hollow airfoil including a flow axis that extends from a forward location to an aft location comprising:

a) a root section located at the base of said airfoil;

b) a tip section located distally from said root section;

c) a leading edge connecting said root section and said tip section and facing forward along the flow axis;

d) a trailing edge connecting said root section and said tip section and facing aft along the flow axis and a chord length extending between said trailing edge and said leading edge that generally bisects a cross section of the airfoil at a radial position between said root and tip sections;

e) a skin that extends between and connects said root section, said tip section, said leading edge and said trailing edge and forms an outer surface of said airfoil;

f) a plurality of spacers located non-uniformly between said leading edge and said trailing edge and enclosed by and supporting said skin to preferentially stiffen said airfoil along said leading edge by forming a plurality of non-uniformly sized cavities having widths that increase in length from said leading edge towards said trailing edge as measured along said chord length;

g) a first side having a first skin thickness distribution that varies along said chord length as measured from said leading edge to said trailing edge and between said root section and said tip section; and h) a second side having a second skin thickness distribution different from said first skin thickness distribution that varies along said chord length and between said root section and said tip section; wherein, said first side skin thickness distribution and said second side skin thickness distribution have increased thicknesses along said leading edge relative to said trailing edge, respectively.

16. A hollow airfoil including a flow axis that extends from a forward location to an aft location comprising:

a) a root section located at the base of said airfoil;

b) a tip section located distally from said root section;

c) a leading edge connecting said root section and said tip section and facing forward along the flow axis;

d) a trailing edge connecting said root section and said tip section and facing aft along the flow axis and a chord length extending between said trailing edge and said leading edge that generally bisects a cross section of the airfoil at a radial position between said root and tip sections;

e) a skin that extends between and connects said root section, said tip section, said leading edge and said trailing edge and forms an outer surface of said airfoil;

f) a plurality of spacers located non uniformly between said leading edge and said trailing edge and enclosed by and supporting said skin;

g) a first side having a first skin thickness distribution that varies along said chord as length measured from said leading edge to said trailing edge and between said root section and said tip section;

h) a second side having a second skin thickness distribution different from said first skin thickness distribution that varies along said chord length and between said root section and said tip section and separated from said first side by said spacers thereby forming a first plurality of cavities and a second plurality of cavities; wherein, said first side skin thickness distribution and said second side skin thickness distribution are each preferentially increased along said leading edge relative to said trailing edge, respectively; said first plurality of cavities having non-uniform widths of increasing length from said leading edge to said trailing edge as measured along said chord length; and said second plurality of cavities having equal widths as measured along said chord length.

17. A hollow airfoil including a flow axis that extends from a forward location to an aft location comprising:

a) a root section located at the base of said airfoil;

b) a tip section located distally from said root section;

c) a leading edge connecting said root section and said tip section and facing forward along the flow axis;

d) a trailing edge connecting said root section and said tip section and facing aft along the flow axis and a chord length extending between said trailing edge and said leading edge that generally bisects a cross section of the airfoil at a radial position between said root and tip sections;

e) a skin that extends between and connects said root section, said tip section, said leading edge and said trailing edge and forms an outer surface of said airfoil;

f) a plurality of spacers located between said leading edge and said trailing edge and enclosed by and supporting said skin and forming a first plurality of cavities and a second plurality of cavities;

g) said first plurality of cavities comprised of non-uniformly sized cavities having first, second, third, fourth and fifth cavities, having first, second, third, fourth and fifth non-uniform widths respectively as measured along said chord length; and h) said second plurality of cavities having sixth, seventh, eighth, ninth and tenth cavities each having an equal width Y as measured along said chord length.

18. A hollow airfoil according to claim 17 wherein said first non-uniform width is in a range between and including 0.45Y and 0.55Y, said second non-uniform width is in a range between and including 0.55Y and 0.65Y, said third non-uniform width is in a range between and including 0.65Y and 0.75Y, said fourth non-uniform width is in a range between and including 0.75Y and 0.85Y, and said fifth non-uniform width is in a range between and including 0.85Y and 0.95Y, inclusive.

19. A hollow airfoil including a flow axis that extends from a forward location to an aft location comprising:

a) a root section located at the base of said airfoil;

b) a tip section located distally from said root section;

c) a leading edge connecting said root section and said tip section and facing forward along the flow axis;

d) a trailing edge connecting said root section and said tip section and facing aft along the flow axis and a chord length extending between said trailing edge and said leading edge that generally bisects a cross section of the airfoil at a radial position between said root and tip sections;

e) a skin that extends between and connects said root section, said tip section, said leading edge and said trailing edge and forms an outer surface of said airfoil;

f) a plurality of spacers located between said leading edge and said trailing edge and enclosed by and supporting said skin and forming a first plurality of cavities and a second plurality of cavities;

g) said first plurality of cavities comprised of non-uniformly sized cavities having first, second, third, fourth and fifth cavities, having first, second, third, fourth and fifth non-uniform widths respectively as measured along said chord length; and h) said second plurality of cavities having sixth, seventh, eighth, ninth and tenth cavities each having an equal width Y as measured along said chord length;

i) a first side extending substantially along said chord length measured from said leading edge to said trailing edge and bounded by said root section, said tip section, said leading edge and said trailing edge;

j) a second side extending substantially along said chord length and bounded by said root section, said tip section, said leading edge and said trailing edge and separated from said first side by said spacers; and k) wherein said first side is thicker than said second side and said first side skin thickness and said second side skin thickness are each greater along said leading edge than along said trailing edge, respectively.

20. A hollow airfoil according to claim 19 wherein said first non-uniform width is in a range between and including 0.45Y and 0.55Y, said second non-uniform width is in a range between and including 0.55Y and 0.65Y, said third non-uniform width is in a range between and including 0.65Y and 0.75Y, said fourth non-uniform width is in a range between and including 0.75Y and 0.85Y, and said fifth non-uniform width is in a range between and including 0.85Y and 0.95Y, inclusive.

21. A hollow airfoil according to claim 19 wherein said first side skin thickness for said first cavity is between 1.4 Z and 1.6 Z inclusive, said first side skin thickness for said second cavity is between 1.2 Z and 1.4 Z inclusive, and said first side skin thickness for said third cavity is between Z and 1.2 Z, inclusive; and said second side skin thickness for said first cavity is between 1.4Z+B and 1.6Z+X inclusive, said second side skin thickness for said second cavity is between 1.2Z+X and 1.4Z+X inclusive, and said second side skin thickness for said third cavity is between Z+X and 1.2Z+X inclusive; wherein Z is the thinnest skin thickness of said sides and X is between 0.005 inches and 0.025 inches.

22. A hollow airfoil including a flow axis that extends from a forward location to an aft location comprising:

a) a root section located at the base of said airfoil;

b) a tip section located distally from said root section;

c) a leading edge connecting said root section and said tip section and facing forward along the flow axis;

d) a trailing edge connecting said root section and said tip section and facing aft along the flow axis and a chord length extending between said trailing edge and said leading edge that generally bisects a cross section of the airfoil at a radial position between said root and tip sections;

e) a skin that extends between and connects said root section, said tip section, said leading edge and said trailing edge and forms an outer surface of said airfoil;

f) a plurality of spacers located between said leading edge and said trailing edge and enclosed by and supporting said skin and forming a plurality of non-uniformly sized cavities having non-uniform widths as measured along said chord length; and g) a first side extending substantially along said chord length measured from said leading edge to said trailing edge and bounded by said root section, said tip section, said leading edge and said trailing edge;

h) a second side extending substantially along said chord length and bounded by said root section, said tip section, said leading edge and said trailing edge and separated from said first side by said spacers;

i) wherein said first side is thicker than said second side and said first side skin thickness and said second side skin thickness are each greater along said leading edge than along said trailing edge, respectively; and j) said first side skin thickness for said first cavity is between 1.4 Z and 1.6 Z inclusive, said first side skin thickness for said second cavity is between 1.2 Z and 1.4 Z inclusive, and said first side skin thickness for said third cavity is between Z and 1.2 Z, inclusive; and said second side skin thickness for said first cavity is between 1.4Z+X and 1.6Z+X inclusive, said second side skin thickness for said second cavity is between 1.2Z+X and 1.4Z+X inclusive, and said second side skin thickness for said third cavity is between Z+X and 1.2Z+X inclusive; wherein Z is the thinnest skin thickness of said sides and X is between 0.005 inches and 0.025 inches.

* * * * *